United States Patent [19]

Goldstein

[11] Patent Number: 4,796,441

[45] Date of Patent: Jan. 10, 1989

[54] ICE MAKING MACHINE

[75] Inventor: Vladimir Goldstein, Concord, Canada

[73] Assignee: Sunwell Engineering Company Limited, Concord, Canada

[21] Appl. No.: 105,951

[22] Filed: Sep. 28, 1987

Related U.S. Application Data

[63] Continuation of Ser. No. 739,225, May 30, 1985, abandoned.

[51] Int. Cl.[4] ..... F25C 1/00

[52] U.S. Cl. ..... 62/354; 165/94

[58] Field of Search ..... 62/354; 165/94; 366/311

[56] References Cited

U.S. PATENT DOCUMENTS

| | | | |
|---|---|---|---|
| 2,101,953 | 9/1936 | Öman . | |
| 2,259,841 | 10/1941 | Spiegl | 62/67 X |
| 2,419,881 | 6/1944 | Borgerd et al. . | |
| 3,004,395 | 10/1961 | Morris, Jr. . | |
| 3,191,398 | 6/1965 | Rader | 62/354 X |
| 3,220,204 | 11/1965 | Adler et al. . | |
| 3,247,678 | 4/1966 | Mohlman . | |
| 3,328,972 | 7/1967 | Svanoe | 62/123 |
| 3,488,974 | 1/1970 | Lunde et al. | 62/354 X |
| 4,059,047 | 11/1977 | Sollich | 62/354 X |
| 4,271,682 | 6/1981 | Seki . | |
| 4,334,412 | 6/1982 | Wildfeuer . | |
| 4,401,449 | 8/1983 | Martin et al. . | |
| 4,538,428 | 9/1985 | Wilkerson . | |
| 4,596,120 | 6/1986 | Knodel et al. . | |

*Primary Examiner*—William E. Tapolcai

*Attorney, Agent, or Firm*—Spencer & Frank

[57] ABSTRACT

An ice making machine comprises a housing having a cooled wall. A eutectic mixture is passed across the wall to be cooled below its freezing point and form ice. A blade continuously wipes the wall to move the fluid away from the wall and into the body of the fluid. The blades are moved by a drive means at a rate such that the surface is wiped prior to crystalization of the ice on the wall.

19 Claims, 4 Drawing Sheets

ICE MAKING MACHINE

This application is a continuation of application Ser. No. 06/739,225, filed May 30, 1985, now abandoned.

This invention relates to a continuous method for making ice and contains subject matter which is entitled to the benefit of the filing date of application Ser. No. 26,561 filed on Apr. 3, 1979, which is a continuation of application Ser. No. 06/197,553 filed on October 16, 1980, which in turn is a continuation of application Ser. No. 067/419,548 filed on Sept. 17, 1982 and also this application contains subject matter which is entitled to the benefit of the filing date of application 631,952 filed July 17, 1984.

In today's society vast quantities of ice are used in the preservation and processing of food products. By way of example, it is considered that two pounds of ice are required for each pound of fresh poultry that is retailed. The fishing industry, the dairy industry and the fruit and vegetable industry are also large consumers of ice. Service industries such as hotel, restaurant and hospital also use large quantities. Further, ice is consumed in large amounts in many manufacturing industries.

The manufacture of ice is, therefore, of itself, an important industry. A good proportion of ice manufacturing today is manufactured in block on a batch basis. This is relatively inefficient method. It is labour oriented and time consuming because the large blocks of ice produced take up to 48 hours to form. Inefficiency is increased by the requirement to use heat to melt the bond between the ice and the evaporator. The cost of providing this heat in the harvesting step along contributes substantially to the inefficiency of the process. Notwithstanding these inefficiencies, however, the method continues to be used.

There are also continuous methods of making ice in current use with mixed success. In the continuous methods of making ice presently used ice is formed from water on the walls of an evaporator from which it must be broken away by a rotating auger. Variations of bond strength and irregular pattern of ice formation have caused an irregular torque requirement for the auger shaft drive. The irregularity of this torque requirement has been such that many attempts at evaporator designs for continuous ice making machines have failed.

It is known to take a mixture that is at less than eutectic concentration, contain it in container, agitate the mixture, and cool the sidewall of the container to crystalize water in the solution and concentrate the remainder. Such a general method is the basis for making ice cream. The method has also been proposed to be used for the concentration of the eutectic solution in the case where the solution is, for example, brewed coffee or orange juice. Such a proposal is found in U.S. Pat. Nos. 3,328,972 and 3,328,058 to Svanoe.

In the Svanoe reference a coffee or like brew is described and the brew is concentrated by the continuous removal of ice crystals which are formed. In this patent the brew mixture is contained in a container and the sidewall is cooled to cool the mixture below its freezing point and form ice crystals which are removed. It is necessary to prevent crystal formation on the sidewall of the container and Svanoe discloses the achievement of this by operating agitators to maintain a turbulent zone of annular cross section defined by the ends of the agitators and the cooling wall of the container. The turbulence of the liquid in this zone scours the sidewall to prevent crystals of ice from building up. The mixture is subcooled in the turbulent zone and passes therefrom to the centre area where larger harvestable water ice crystals grow. These larger water ice crystals are removed to yield a more concentrated brew. In the disclosed method ice making is not the end object but ice is a byproduct. Concentration of the brew is the object of the method.

The method of Svanoe is a very delicately balanced method and operating conditions must be carefully controlled. It is important that ice crystals should not form on the sidewall of the container. This would stop the process. They must be directed to the centre of the container before they reach harvestable size. If the Svanoe method is capable of doing this at all it is capable of doing it under difficult to control conditions only and only at a rate that would not give any reasonable production of ice if the method were extended as a means of producing ice as a marketable end product.

In his specification, Svanoe expresses concern about the formation of ice crystals on the container wall. The reason is that if ice crystals form on the container wall the process is stopped because the general process essentially is subcooling the mixture at the container wall and removing it to the centre area where it can grow into crystals at a reasonable rate for crystal removal. Thus, prevention of the formation of ice crystals on the container wall is important and Svanoe achieves this by maintaining a high agitation zone close to the wall of the container. As noted above, the agitated liquid close to the container wall scours the wall and removes ice particles before they grow to harvestable size. This method, however, is not efficient. As appears from Svanoe's specification at column 7, line 42, heat is transferred through the heat transfer surface of the container at a rate of about 300 1600 BTU's per square foot per hour. To increase this heat transfer rate with the Savnoe method would result in crystal build-up on the container wall and breakdown of the method. A good many precautions are necessary in order to get even this relatively low heat transfer with Svanoe. For example, he must provide for feed-back of ice crystals in order to provide for crystal growth. He must also accurately control temperature differentials throughout the system. Thus, his method is capable of only a low rate of heat transfer and it is delicately balanced. It is not efficient enough from a capacity point of view to produce ice on a commercial basis.

The Svanoe method is inefficient. It is possible to operate equipment of the Svanoe type with applicant's method and achieve a water ice ouput of over ten times that of Svanoe. Svanoe claims in his specification to be able to transfer about 300 to 1600 BTU's per square foot per hour by using the applicant's invention.

The applicant scours differently from Svanoe and is able thereby to maintain a critical temperature range at the heat transfer surface to effectively avoid crystalization at the surface thereby increasing the the ice making efficiency to a most remarkable extent.

The essential difference in the applicant's method and the method of Svanoe is that in the case of the applicant's method the inside of the heat transfer surface is wiped by a blade to prevent the formation of water ice crystals. Svanoe uses an entirely different method for attempting to move a super cooled layer of liquid from the surface to the centre and the difference is critical to the achievement of applicant's improved results.

Other patentees in this field, such as Spiegl, form crystals on the side of the container and scrape them. This is a very inefficient method of forming crystals and results in a very low transfer of cooling from refrigerant through the container wall for a given size container.

Svanoe proposed the concept of subcooling the surface layer of liquid in the container and transferring it from the surface to the interior, but he did not know how to effectively put the concept into practice to get a higher yield. With Svanoe the subsurface layer is cooled substantially more than one degree below the freezing point and the formation of ice crystals at the cooling system is inevitable. When this occurs the system breaks down and the efficiency reverts to that of Spiegl where crystals are scraped from the container wall. Applicant avoids the inevitable breakdown of the system disclosed in Svanoe and is able to maintain a high rate of heat transfer and ice crystal production.

Scouring will permit one to operate the system without danger of forming ice crystals on the wall and this is, in numerical terms done by cooling the layer of mixture immediately adjacent the side wall of the container no more than 1° below the freezing point of the mixture in the chamber. The turbulence described in the Svanoe patent is not capable of removing the surface layer at a rate to keep the temperature within the one degree limit if the wall is cooled at a rate of at least 4000 BTU's per square foot of container wall. The combination of these things is not possible with Svanoe with the result that Svanoe is not able to approach any where near the efficiency of the applicant.

The object of this invention is to provide an apparatus for producing ice on a continuous basis that is simple, reliable, free from major operating problems, employs simply designed equipment and is economical.

According to the present invention there is provided an ice-making machine comprising housing to receive a fluid from which ice is to be made and having an outlet to permit the egress ice from said housing, a heat exchanger means located within said housing and having a coolant inlet and a collant outlet to permit a flow of coolant to extract from said fluid, and including at least one heat exchange surface separating coolant from said fluid, means to maintain a body of fluid in said housing to fill substantially said housing and cover said heat exchange surface, blade means in contact with said surface and movable about an axis to move across said surface, and drive means operable upon said blade means to drive said blade means about said axis, said drive means moving said blade means across said surface at a speed such that successive passes of said blade means removes a cooled layer prior to crystallization of ice on said surface, said blade means being configured to discharge fluid from said surface into the body of fluid in said housing to maintain a substantially uniform temperature therein.

Embodiments of the present invention will now be described by way of example only with reference to the accompanying drawings in which FIG. 1 is a schematic illustration of apparatus for practising the invention; and FIG. 2 is an illustration of a temperature concentration curve for a brine mixture.

This invention has been successfully practiced using the freezing system of a Neopolitan Vogt-Model V3100 ice cream freezer and a NaCl brine mixture and it will be described having regard to that apparatus and mixture. It is, however, not intended that the invention be limited to that apparatus or that mixture.

Figure 1:
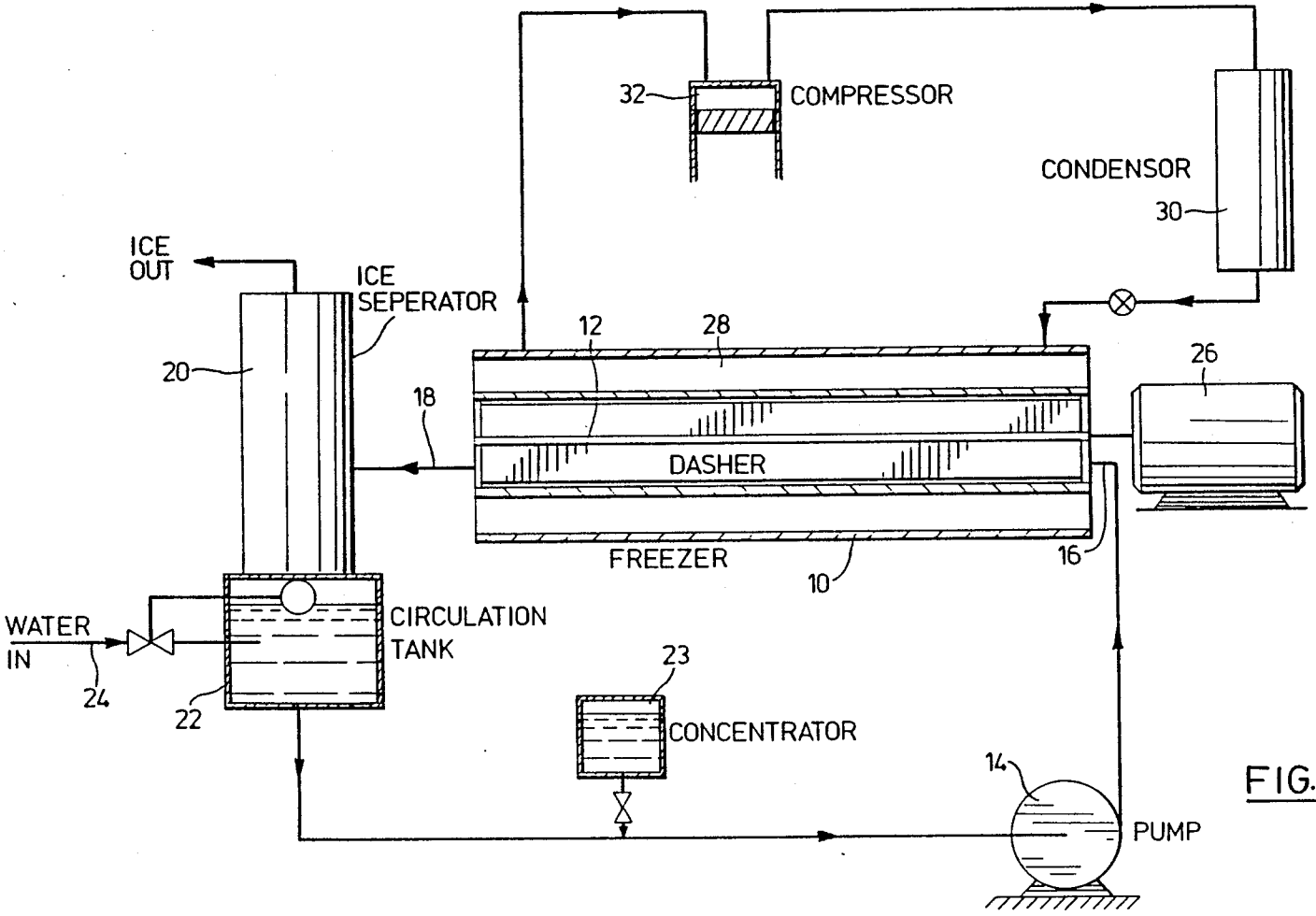

In FIG. 1 the numeral 10 refers to a freezing cylinder. It has a dasher chamber 12 through which a brine mixture is continuously circulated by means of the pump 14. The brine mixture enters the chamber as at 16, is cooled therein to form ice crystals as will be referred to later and leaves the chamber from exit port 18 as a pumpable slush-like mixture. It then proceeds to a mechanical separator 20, which in the apparatus successfully operated to date consists of a strainer that holds the ice crystals and permits the liquid of the mixture to pass through. The ice crystals are removed and the remaining mixture is conducted to the circulation tank 22. Water from the supply 24 is added to the circulation tank to replace the water taken from the brine mixture by removal of the ice crystals. Thus, the water that makes the ice is added to the system as make-up water. Numeral 23 is a tank containing concentrated solute which can be added to the system as required to replace lost solute.

Within the dasher chamber a scouring paddle is continuously rotated by motor 26 to scour the sides of the chamber and prevent a build-up of ice on them. The scouring paddle is of standard design on these machines.

The dasher chamber is surrounded by a jacket 28 to which a condensed refrigerant is continuously supplied from condenser 30. The refrigerant boils in the jacket, and as it does so cools the brine mixture in the chamber to form ice crystals therein. The expanded refrigerant travels from the jacket to the compressor 32 where it is compressed and delivered to the condenser for continuous recycling as in a conventional refrigeration cycle.

As indicated, the freezer, dasher chamber, scouring paddle and associated refrigeration circuit are standard and well known pieces of equipment and detailed reference is not made to them.

Figure 2:
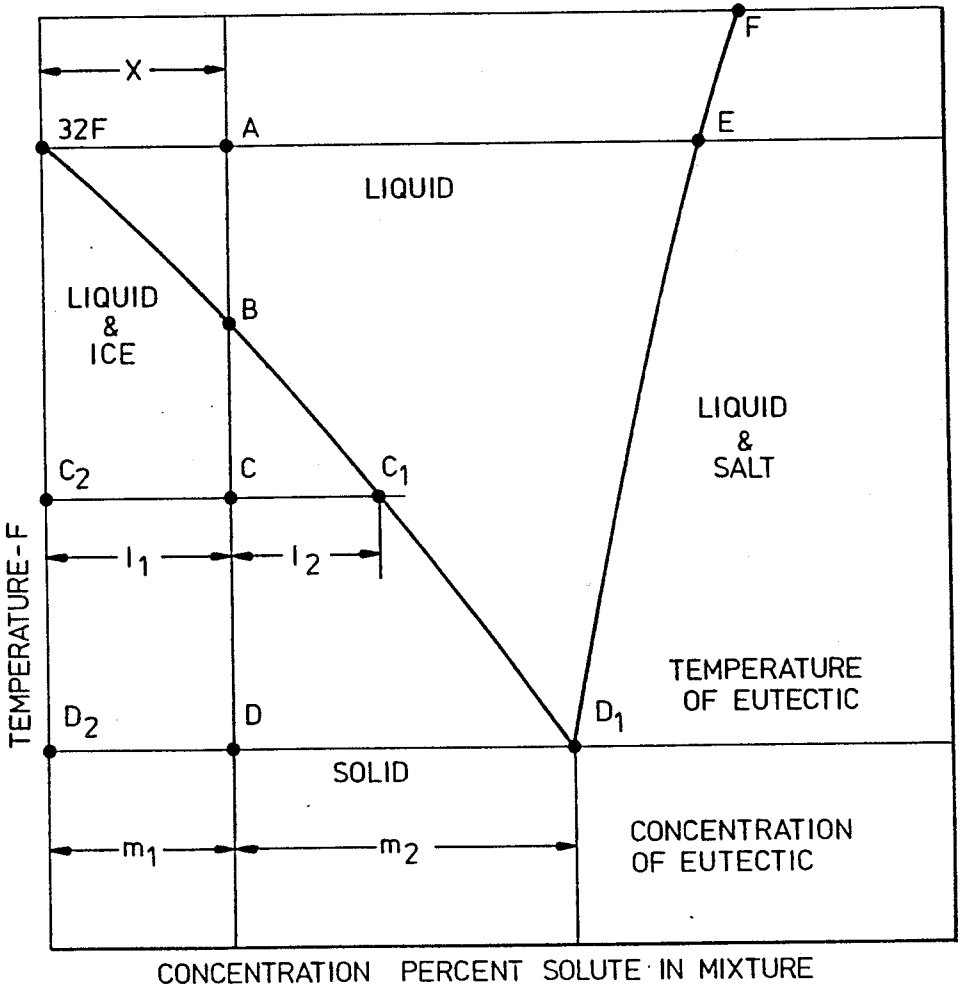

Reference to FIG. 2 will be made to explain the invention. This figure illustrates well known characteristics of a brine mixture wherein the solvent is water and the solute is NaCl.

This solution will freeze at the eutectic temperature or temperature of eutectic indicated on the figure. The physical phenomena that occur as the temperature of such a solution is cooled towards the freezing point depends upon its concentration. If the concentration is represented by a point to the left of the point $D_1$ on the curve ice crystals are formed and the concentration of the solution increases as the freezing temperature is approached.

The temperature represented by points D on the curve is known as the eutectic temperature and the concentration represented by the point $D_1$ on the curve is known as the eutectic concentration.

Referring to FIG. 2, if a solution of concentration x, less than the eutectic, at a temperature above 32F, is cooled, it will not solidify when 32F is reached (point A), but continue to cool as a liquid until point B is reached. At this point, ice crystals of pure water will begin to form, accompanied by removal of their latent heat. This increases the concentration of the residual solution. As the temperature is lowered, these crystals continue to form, and the mixture of ice crystals and brine solution forms a slush. When point C is reached, there is a mixture of ice crystals $C_2$, and brine solution of concentration $C_1$, in the proportions of $l_1$ parts of brine to $l_2$ parts of ice crystals in $(l_1+l_2)$ parts of mixture. When the process has continued to point D, there is a mixture of $m_1$ parts of eutectic brine solution $D_1$, and $m_2$ part of ice $D_2$, all of the eutectic temperature. As more heat is removed, the $m_1$ parts of eutectic brine freeze at uniform temperature until all latent heat is removed. The frozen eutectic is a mechanical mixture of salt and frozen water, not a solution, and consequently the latent heat must be corrected for the heat of solution. If this is positive, it decreases effective latent heat; if negative, it increases the effective latent heat.

If the initial solution concentration is greater than the eutectic, salt instead of water freezes out as temperature lowers, and the concentration decreses until, at the eutectic temperature, eutectic concentration is reached. In brines used as refrigerating fluid, salt sometimes freezes out because concentration is too high.

With this invention one maintains a concentration of the brine less than the eutectic and preferably about point B on the eutective curve. One does not cool to the eutectic temperature but does cool to form ice. As ice is formed, the ice and the concentrated mixture form a pumpable slush-like composition which is forced into the separator. Water is added to the mixture that is returned to the dasher chamber of the freezer from the supply 24 to maintain the concentration of the mixture workable for the production of ice as it is cooled.

By the addition of water to maintain the concentration of the solution at less than the eutectic concentration one supplies the water to make ice. The cylinder 10 is an especially efficient ice making device because it employs an efficient heat transfer from the refrigerant to the water that is formed into ice.

As the water freezes to take up its heat of crystalization, heat is taken up around the entire surface of the crystal that forms. It represents a very large surface area per unit of water, With many ice making machines when the ice is formed by buildng a layer on a heat transfer surface of a cylinder the heat transfer surface is small by comparison.

It will be apparent that with this method a certain amount of brine will be removed with the ice and provision is made for maintaining salt strength with concentrator 23. It can be operated to add salt as required.

The scouring paddle operates at a rate of speed that is fast enough to carry the cooled layer of mixture at the side wall towards the centre of the container before the cooled layer crystalizes on the side wall of the container. The paddle tends to move the cooled surface layer in a spiral path towards the longitudinal central axis of the chamber whereby it mixes with the general body of mixture in the chamber and cools the general body of mixture to form ice crystals throughout the body of the mixture. The speed will vary with equipment design and operating conditions but with two scouring blades and a cylindrical chamber having a diameter of about three inches a scouring paddle rotation of about 350 r.p.m. was found satisfactory.

The transformation of water from the liquid to the crystal or solid state takes place suddenly and requires a very substantial amount of energy. The liquid brine must be cooled below its freezing point before crystalization will take place. It is so cooled in a surface layer on the side of the chamber but in the interval before crystalization takes place the so cooled surface layer is moved by the rotating scouring paddle from the side wall of the container towards the centre of the container. The cooled liquid thus removed from the side wall surface of the chamber crystalizes into ice on the centers of crystalization present in the liquid. Thus, the brine acts as a secondary refrigerant in the formation of ice throughout the body of the mixture.

The paddles rotate around the heat exchange wall of the chamber and preferably form a scoop angle therewith of about 45 degrees in the direction of rotation to force the cooled liquid towards the centre of the chamber on a continuous basis.

The system is a very efficient one for forming ice and provides for maximum contact of the brine with the heat exchange surface of the chamber.

As an example, a typical heat exchange chamber having a diameter of three inches has a heat transfer coefficient between the brine and refrigerant of 500 BTU's per hour per square foot per degree Farenheit and the temperature difference between the refrigerant and the brine is 10 degrees Farenheit.

Thus, the capacity of this unit is $500\times10=5000$ BTU's per hour per square foot of chamber wall.

The blades in the unit rotate and scour the sides of the chamber, for example 350 times per minute and there are two of them so that the dwell time of the surfaced layer of mixture at the side wall of the chamber is $1/350\times2=0.00143$ minutes$=0.000024$ hours. The drive means moves the blades at a rate such that the inverval between successive passes of the blades is less than 0.00144 minutes.

The heat given up by the brine mixture to the heat exchange wall in this time is $5000\times0.000024=01119$ BTU's per rotation of the blade per square foot.

To form ice requires 150 BTU's per pound of ice.

Thus, in one rotation of the auger there is sufficient heat exchange to form $0.119/150=0.00079$ pounds of ice per square foot of chamber wall.

Ice at 28 degrees Farenheit has a density of 57.3 lbs per cubic foot. Assuming that 0.00079 lbs per square foot of ice form on each rotation of the auger the maximum thickness of the ice layer before removal from the side of the chamber is $0.00079/57.3=0.000013$ inches. This is not enough to constitute an ice layer.

The diameter of the ice crystals harvested from the unit are between 0.002 and 0.003 inches. This is 154 to 384 times the thickness of ice that could be formed on the wall between scouring so that it is clear that with this rate of scouring crystals cannot grow to a harvestable size on the side wall of the heat exchanger. The 0.09 seconds that the brine contacts the wall is not sufficient for crystal formation.

The mixture adjacent the cooling surface of the container that is subcooled in this method is about 0.2 degrees Centigrade lower than the mixture freezing point. The heat given up by the brine to the heat exchanger is 0.119 BTU's per rotation of the blade per square foot of heat exchanger area. This amount of heat transfer represents a subcooling of the mixture to about 0.2 degrees Centigrade below its freezing point. In the method described in Svanoe patent referred to above the mixture close to the heat transfer surface is subcooled to about 3 to 8 degrees Centigrade below the solution freezing point. This striking difference results from the basically different methods of scouring used according to this applicant's method and the method of Svanoe. In Svanoe there is not efficient removal of the subcooled liquid from immediately adjacent the heat transfer surface to avoid problems of ice formation in the area. Svanoe has a turbulent zone of substantial thickness at the heat transfer surface with the result that there is a higher degree of subcooling of a substantially greater volume of mixture. In Svanoe there are great temperature variations within the container. In the case of the present invention the subcooled layer is of infinitesimal thickness as noted above. The subcooled layer is removed as it is formed and at a fast rate so that apart from this very small volume the temperature is substantially the same throughout most of the volume of the container. It is more conducive to good crystal growth throughout the container for harvesting.

The scouring rate will vary with equipment and capacity but in every case the idea is to scour at a rate that avoids cooling substantially below the freezing point at the surface and crystal growth on the side of the heat exchanger chamber whereby to promote crystal growth and formation throughout the body of the mixture.

The mechanical scouring of the surface will achieve a high scouring rate capable of preventing crystal growth on the container wall. It gives a good yield of ice crystals. It will be apparent that for a given piece of equipment the yield of ice will increase with temperature rate of heat transfer. If the rate of heat transfer from the container wall to the mixture tends to be less than 4000 BTU's per square foot per hour of container wall the method becomes insufficient. High ice output for a given size piece of equipment is the key to successful operation. Rates of heat transfer of between 4000 and 5000 BTU's per square foot per hour are contemplated. The higher the rate the more efficient the operation as to capacity.

The method disclosed in the Svanoe patent disclosed above is not capable of operation at these production rates. Svanoe would not remove ice formation from the wall at this rate.

This method further achieves a vast improvement in machine capacity over a method wherein the crystals are permitted to grown on the wall of the chamber and are then harvested by scraping them from the wall with a lower speed auger. With such a method the temperature of the bulk of the mixture is always substantially above freezing and formation of ice crystals takes place only on the limited area of the wall of the chamber. It is not possible to form ice crystals in the bulk of the mixture that is above freezing temperature.

Further, the place of removal of the ice is not critical. It would in the apparatus illustrated by strained in the cylinder and make up water added to the cylinder.

Solutions other than brine could be used. The solvent should, of course, be water based to make ice but the solution could be any nontoxic material that has a suitable eutectic characteristic. Substitutes for salt might be glycerine, propylene glycol, ethanol or calcium chloride.

The ice crystal grow throughout the liquid rather than from the wall outward in a layer. Crystals that form near the wall may attach themselves to the wall but they are removed from the wall as the blades rotate. The growth throughout the liquid is achieved by prevention of larger build up at the cooled surface by mechanical scouring at a rate so that the temperature at the wall is not more than one degree centigrade below freezing point and is preferably no more than 0.2 degrees centigrade less than freezing point.

The foregoing example is of a subcooling of about 0.2 degrees centigrade. The subcooling throughout the mixture cannot be more than this. The amount of subcooling with this invention is necessarily small because the subcooled layer must be removed before it grows to any appreciable size. Subcooling up to one degree centigrade at the surface is contemplated. Greater subcooling than this would result in poor heat transfer.

The unit with a chamber diameter of three inches and three feet in length referred to above has been operated according to this invention to produce 400 pounds of ice per hour. Water is preferably added at a constant rate on a continuous basis but it can be added at intervals provided that the concentration of the brine does not get too high. If the concentration gets too high the process becomes less efficient and if it becomes so high that it passes the eutectic point salt will be deposited in the tank. As concentration gets high ice yield gets low. If concentration is too low one gets too much ice for easy mechanical operation of the unit. Separation of ice from the slush can be done many ways including centrifugal.

Figure 3:
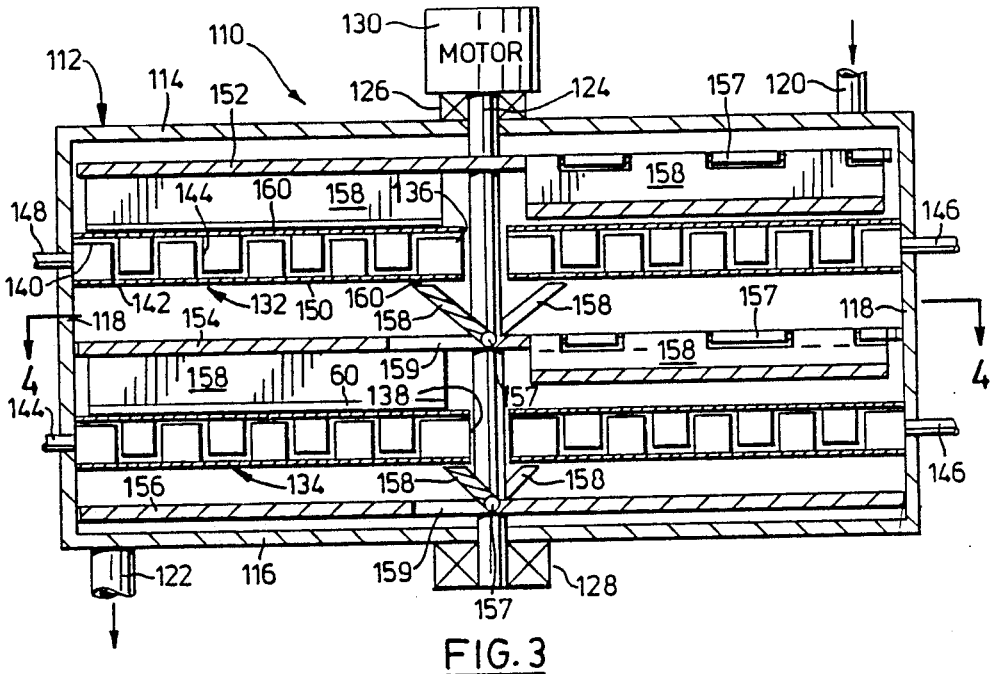
FIG. 3 is a sectional view of a second embodiment of an ice making machine.
Figure 4:
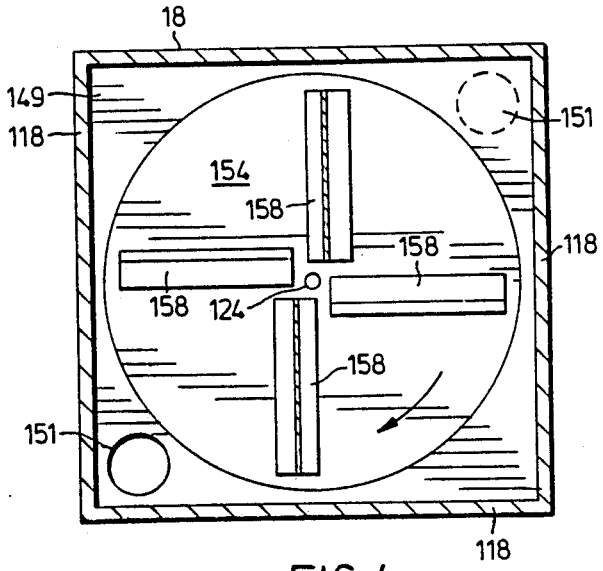
FIG. 4 is a view on the line 4—4 of FIG. 3.
Figure 5:
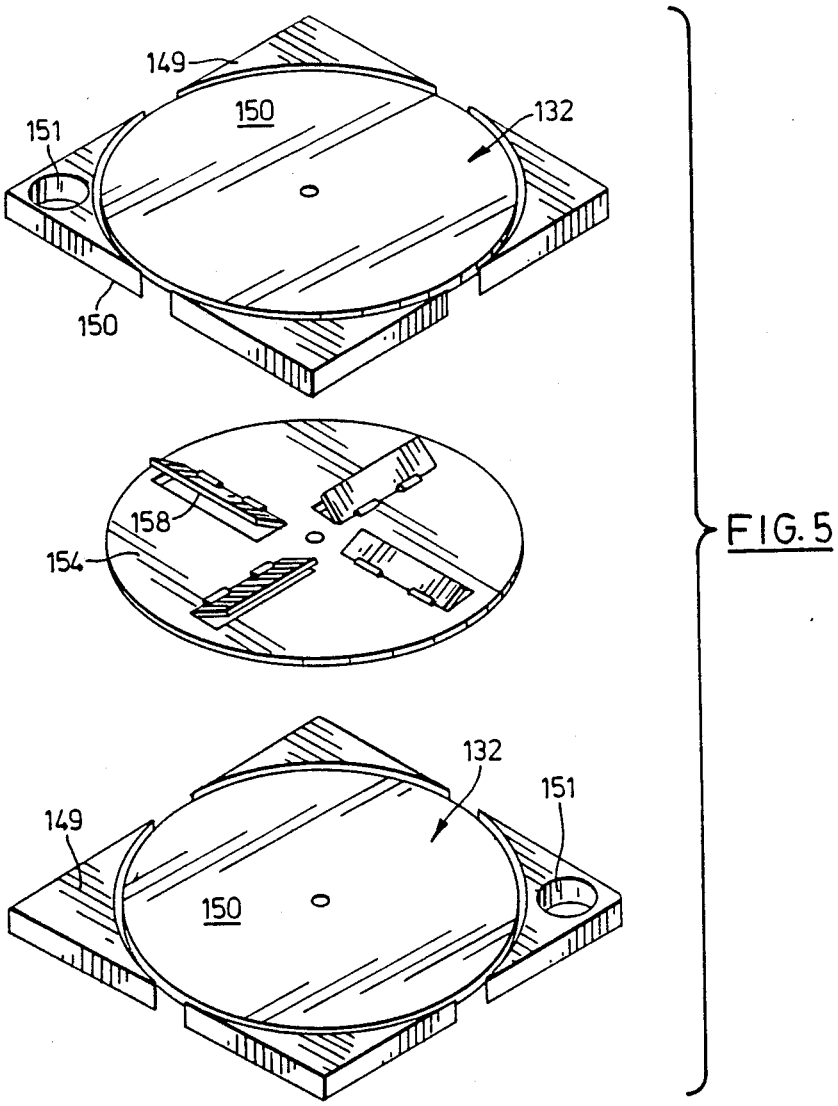
FIG. 5 is an exploded perspective view of the embodiment.

An alternative form of ice generator is shown in FIGS. 3 to 5. The ice making machine 110 includes a housing 112 having upper and lower end plates 114, 116 respectively and side walls 118. The end plates 114, 116 are square when viewed in plan and cooperate with the side walls 118 to define an enclosed housing. The housing 112 is preferably made from an insulated material to reduce the heat transfer across the walls 114, 116, 118.

An inlet 120 is provided on the upper plate 114 to receive the secondary refrigerant, and an outlet 122 is provided in the lower plate at a diametrically opposite location. Thus, fluid entering the inlet 120 is forced to traverse the housing 112 to reach the outlet 122.

An agitator shaft 124 extends through the housing 112 between the plates 114 and 116 and is rotatably supported at opposite ends by bearings 126, 128 located exteriorly of the housing. The shaft 124 is driven by a motor 130 that is supported on the upper plate 114.

A pair of heat exchanger assemblies 132, 134 is located in the housing 112. The heat exchanger assemblies extend between opposite peripheral walls 118 generally parallel to the end walls 114, 116 and normal to the axis of rotation of the shaft 124. Each of the heat exchanger assemblies 132, 134 is formed with a central aperture 136, 138 respectively to accommodate the shaft 24.

Each of the heat exchangers 132, 134 is of similar construction and accordingly only one will be described in detail. The heat exchanger 132 is formed from a pair of spaced parallel plates 140, 142 of generally circular shape. The plates 140, 142 are maintained in spaced relationship by a honeycomb structure 144 that has open mesh partitions to permit the flow of fluid between the plates whilst maintaining a structural connection between them. An inlet 146 is associated with each heat exchanger and passes through the side wall 118 of the housing. At a diametrically opposed location, an outlet 48 is provided so that coolant may flow from the inlet 146 through the honeycomb structure between the plates 140 and 142 to the outlet 148.

The space between the heat exchangers 132, 134 and the walls 118 is sealed by spacers 49 located in each corner of the housing 112. An aperture 151 is provided in one of the spacers associated with each heat exchanger to permit flow of fluid from one side of the heat exchanger to the other. Successive apertures 51 are arranged in diagonally opposite corners of the housing 112 so that fluid flowing through the housing 112 is caused to flow across each of the heat exchangers 132, 134.

Each of the plates 140, 142 has an outwardly directed heat exchange surface 50 that contacts the fluid provided through the inlet 120. To inhibit the deposition of ice upon the surfaces 150, an agitator assembly is connected to the shaft 124. The agitator assembly consists of a series of disks 152, 154, 156 that are secured to the shaft 124 for rotation therewith. The disk 152 is located between the heat exchanger 132 and the upper end plate 114; the disk 154 is located between the two heat exchangers 132, 134 and the lower disk 156 is located between the heat exchanger 134 and the lower end plate 116.

Extending from each of the disks 152 toward a respective one of the surfaces 150 is a pair of blades 158. The blades 158 are pivotally connected to the disk 152 by a hinge 157 and in the operative position are inclined to the plane of the disk. The blades 158 terminate in a bevelled edge 160 that is in a scraping relationship with the surface 150. The blades 158 are generally rectangular in shape and are accomodated in a rectangular slot 159 in the surface of the disk. The blades 158 are biased into engagement with the surface 150 by flow of fluid past the blades up in rotation of the shaft 124. Resilient biasing means such as torsion springs may be incorporated into the hinge 157 to bias the blades toward the respective surface 150.

The disks 152, 156 each carry a pair of blades 158 directed to the upper heat exchange surface 150 of the heat exchanger 132 and lower heat exchanger surface 150 of the heat exchanger 134 respectively. The disk 154 carries two pairs of blades 158, one pair directed to the undersurface of the heat exchanger 132 and the other pair directed to the upper heat exchange surface 150 of the heat exchange 134. Each pair of blades is aligned on a diameter of the disk with the two pairs disposed at 90° to one another.

In operation, brine is fed to the inlet 120 and circulates through the housing 112, around the heat exchangers 132, 134 through the apertures 151 to the outlet 122.

The primary refrigerant, usually freon, is introduced through the inlet 146 of each of the heat exchangers 132, 134 from the condenser 30 where it flows through the heat exchanger to the outlet 44. As the freon passes through the heat exchanger it absorbs heat through the heat exchange surfaces 150 and boils. The brine in contact with the heat exchange surfaces is thus supercooled. To avoid deposition of the ice on the surface 150 which would inhibit further heat transfer, the agitator assembly is rotated by the shaft 124. Rotation of the shaft 124 rotates the disk 152 and thereby sweeps the blades 158 over their respective heat exchange surfaces 150. The movement of the blades removes the super cooled brine from adjacent the surfaces 150 and distributes it through the body of the brine solution. The super cooled brine will crystalise on centers of crystallisation present in the solution and in turn act as new centres of crystallisation to generate three dimensional crystallisation of the water within the brine solution and thus promote the fomration of ice in a crystalline manner. The brine solution with the crystallized ice in suspension is extracted from the outlet 22 where it may be passed to a separating tower (20) for removal of the balance of the brine solution and conveyed to a storage device or directly to the induce for the ice or directed to the thermal storage heat exchanger 52.

The disposition of the heat exchangers in a plane normal to the axis of rotation of the shaft 124 facilitates the modular expansion of the ice making machine for increased capacity without imposing significant additional structural loads upon the apparatus.

It is anticipated that the capacity of the device utilising a pair of heat exchangers with a diameter of 30 inches would be 6–12 tons per day. The plates 50 would typically be between ⅜–1 thick to provide good heat transfer between the coolant and the brine solution with the honeycomb partitions 144 providing the required strength.

The shaft 124 will be rotated at 150–400 rpm with a throughput of 9–18 gallons per minute.

If desired, the surfaces 150 may be coated with a release agent to inhibit the deposition of ice on the surface. Such a coating may typically be polytetrafluoroethylene, or a silicone water repellant liquid such as Dow Cornings Latex; Silicone 804 or Silicone 890. These may be painted and baked on in accordance with the normal use of such coatings. If coatings are utilised then the blades 158 may act as wipers rather than scrapers as the coating will in itself discourage the deposition of the crystals.

Figure 6:
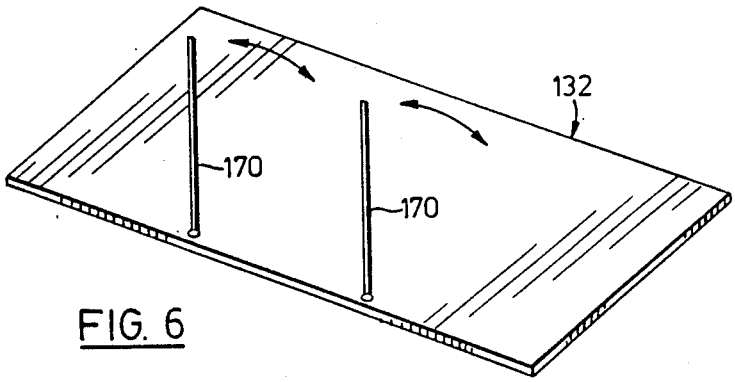
FIG. 6 is a schematic illustration of a third embodiment of ice making machine.

FIG. 6 shows schematically an alternative arrangement of the heat exchange and agitators in which the disks 152, 154 and 156 are replaced by oscillating wipers 170. The wipers may be driven by any suitable form of oscillating mechanism, but again their axes of rotation are normal to the plane of the heat exchanger assembly.

It will be appreciated that the blades 158 may be supported on any convenient carrier assembly connected to the shaft 124, such as a spider arrangement, rather than the discs 152, 154, 156. Further the plates 140, 142 may be maintained in spaced relationship by studs extending between and normal to the plates 140, 142. Whilst the additional surface area provided by the honeycomb portion 44 is considered beneficial, satisfactory results may be obtained by utilising the studs and a coating on the interior of the plates to promote heat transfer. Such a coating is available from Union Carbide under the trade name High Flux coating.

I claim:

1. An ice-making machine comprising housing to receive a fluid from which ice is to be made and having an outlet to permit the egress ice from said housing, a heat exchanger means located within said housing and having a coolant inlet and a coolant outlet to permit a flow of coolant to extract from said fluid, and including at least one heat exchange surface separating coolant from said fluid, means to maintain a body of fluid in said housing to fill substantially said housing and cover said heat exchange surface, blade means in contact with said surface and movable about an axis to move across said surface, and drive means operable upon said blade means to drive said blade means about said axis, said drive means moving said blade means across said surface at a speed such that successive passes of said blade means removes a cooled layer prior to crystallization of ice on said surface, said blade means being configured to discharge fluid from said surface into the body of fluid in said housing to maintain a substantially uniform temperature therein.

2. An ice making machine according to claim 1 including separator means connected to said outlet to separate ice from the balance of said fluid.

3. An ice making machine according to claim 2 including a conduit to return the balance of said fluid to said housing.

4. An ice making machine according to claim 3 wherein said conduit includes constituent inlets to adjust the balance of said fluid to its original composition.

5. An ice making machine according to claim 1 wherein said surface extends transverse to said axis.

6. An ice making machine according to claim 5 wherein said blade means includes a plurality of blades each movable about said axis to sweep respective ones of said surfaces.

7. An ice making machine according to claim 1 wherein said drive means moves said blade means at a rate such that the interval between successive passes of said said blade means is less than 0.00144 minutes.

8. An ice making machine according to claim 1 wherein said drive means moves said blade means such that said surface is wiped more then 150 times per minute.

9. An ice making machine comprising a housing having an inlet and an outlet to enable fluid to circulate through said housing, a plurality of heat exchangers disposed in said housing and each having an inlet and an outlet to permit circulation of coolant therethrough, each of said heat exchangers including a pair of oppositely directed heat exchange surfaces to transfer heat from fluid within said housing to cool said coolant, means to maintain a body of fluid in said housing to fill substantially said housing to cover said heat exchange surface, a blade assembly to cooperate with said heat exchangers to inhibit deposition of ice on said heat exchange surfaces, said blade assembly including a plurality of blades in contact with respective ones of said surfaces of rotatable about an axis generally perpendicular to a plane containing said surfaces, and drive means to rotate said blade assembly at a rate such that the interval between successive passes of said blades is configured to remove a cooled layer from said surfaces prior to crystallization of ice on said surface, said blade means being configured to discharge fluid from said surface into the body of fluid in said housing to maintain a substantially uniform temperature therein.

10. An ice making machine according to claim 8 wherein one surface of one of said heat exchanger is directed toward one surface of another of said heat exchangers and said blade assembly includes two pairs of blades supported on a common carrier and rotatable in unison, one pair of blades being directed toward one of said heat exchangers and the other pair of blades being directed toward the other heat exchanger.

11. An ice making machine according to claim 10 wherein each of said blades are moveable about an axis parallel to said heat exchange surface into engagement with said surface.

12. An ice making machine according to claim 11 wherein said common carrier is a disc supported by a rotatable shaft extending through said housing.

13. An ice making maching according to claim 12 wherein said blades are inclined to the plate of the disks.

14. An ice making machine according to claim 10 wherein each of said heat exchange surfaces is coated with a water repellant coating.

15. An ice making machine comprising a housing to receive a fluid from which ice is to be made and having an outlet to permit egressive ice from said housing, a heat exchanger located within said housing and having a coolant in a coolant outlet to permit a flow of a coolant to extract heat from said fluid, and including at least one heat exchange surface separating coolant from said fluid, means to maintain a body of fluid in said housing to fill substantially said housing and cover said heat exchange surface, blade means in contact with said surface movable about an axis to move across said surface, said blade means including a blade inclined to said surface, and drive means operable upon said blade means to drive said means about said axis, said drive means moving said blade means across said surface at a speed such that the interval between successive passes of said blade means being configured to remove a cooled fluid from said surface into the body of fluid inset housing to maintain a substantially uniform temperature therein.

16. An ice making machine according to claim 15 wherein said blades are connected to a shaft passing through said housing and rotatable on said axis and said blades are moveable about an axis parallel to said heat exchange surface.

17. An ice making machine according to claim 7 wherein said blades are pivotted to disks connected to said shaft for rotation therewith.

18. An ice making machine according to claim 17 wherein leading edges of said blades are bevelled to facilitate removal of ice depositions from said heat exchange surfaces.

19. An ice making machine according to claim 16 wherein said drive means rotates said shaft at between 150 r.p.m. and 400 r.p.m.

* * * * *